US005172128A

United States Patent [19]

Bouko et al.

[11] Patent Number: 5,172,128

[45] Date of Patent: Dec. 15, 1992

[54] ANTENNA WITH CIRCULAR POLARIZATION, NOTABLY FOR ANTENNA ARRAY

[75] Inventors: Jean Bouko, Villemoisson S/Orge; Marcel Grosbois, L'Hay Les Roses; Joseph Roger, Bures S/Yvette, all of France

[73] Assignee: Thomson-CSF, Puteaux, France

[21] Appl. No.: 606,694

[22] Filed: Oct. 31, 1990

[30] Foreign Application Priority Data

Nov. 24, 1989 [FR] France ..... 89 15474

[51] Int. Cl.[5] ..... H01Q 21/260; H01Q 9/280; H01Q 21/240

[52] U.S. Cl. ..... 343/797; 343/795; 343/820; 343/905

[58] Field of Search ..... 343/795, 797, 810, 814–816, 343/820–822, 829, 905

[56] References Cited

U.S. PATENT DOCUMENTS

| | | | |
|---|---|---|---|
| 3,725,943 | 4/1973 | Spanos | 343/797 |
| 3,797,020 | 3/1974 | Roger et al. | 343/756 |
| 4,772,890 | 9/1988 | Bowen et al. | 343/700 MS |
| 4,774,520 | 9/1988 | Bouko et al. | 343/783 |
| 4,983,987 | 1/1991 | Woloszczuk | 343/795 |

FOREIGN PATENT DOCUMENTS

| | | | |
|---|---|---|---|
| 0156684 | 10/1985 | European Pat. Off. . | |
| 7912711 | 12/1980 | France | 343/840 |
| 0164303 | 7/1986 | Japan . | |
| 1416343 | 12/1975 | United Kingdom . | |
| 2048571 | 12/1980 | United Kingdom . | |
| 2191044 | 12/1987 | United Kingdom . | |
| 2207005 | 1/1989 | United Kingdom . | |
| 2211024 | 6/1989 | United Kingdom . | |

*Primary Examiner*—Rolf Hille
*Assistant Examiner*—Peter Toby Brown
*Attorney, Agent, or Firm*—Pollock, VandeSande & Priddy

[57] ABSTRACT

An antenna system capable of both circular and linear polarization. The antenna structure includes a symmetrical stripline 90° hybrid coupler, having first and second output branches. A first and second dipolar radiating element is provided, each of the radiating elements having two quarter wave branches formed by folding the stripline conductors. In the first dipolar radiating element, the peripheral conductors of the stripline coupler are folded in the same direction, transverse to the axis of the stripline, and another quarter wave branch is formed by extending the center conductor of the first output branch of the hybrid coupler in an opposite direction. The second dipole radiating element is similarly configured to have two quarter wave branches, comprising the peripheral conductors and the center conductor of a second output branch of the 90° coupler. A second 90° hybrid coupler connected in cascade with the first one permits the selection of either rectilinear polarization or circular polarization to be realized.

5 Claims, 1 Drawing Sheet

ANTENNA WITH CIRCULAR POLARIZATION, NOTABLY FOR ANTENNA ARRAY

BACKGROUND OF THE INVENTION

1. Field of the Invention

The present invention concerns an antenna with circular polarization, notably an elementary antenna for antenna arrays.

2. Description of the Prior Art

There are many circumstances in which it is desirable to have a circular polarization, notably in radar applications where it is known that circular polarization enables the elimination of the echoes produced by obstacles with isotropic reflection, especially rain echoes (caused by droplets of water that are in suspension in the clouds).

Indeed, the wave emitted in a given circular polarization, for example a right-hand circular polarization, will be phase-shifted by 180° by reflection on the obstacle and will therefore be sent back with a reverse polarization, a left-hand circular polarization in this example. It will then be easy, at the receiver, to get rid of this reflection by means of a crossed polarization suppressor.

One of the aims of the invention is to propose an antenna with circular polarization such as this, notably to serve as a primary source (elementary antenna) in an array antenna, said antenna being capable of being supplied directly by a so-called symmetrical strip line.

A symmetrical strip line is constituted by a flat central conductor forming a coaxial cable core, sandwiched between two dielectric thicknesses (possibly air). These are themselves covered on their external surfaces by conductors located in front of the central conductor and supplied in parallel, hence conductors that are equipotential, forming peripheral ground conductors.

This symmetrical strip line technology is very common, especially in the array antennas, for it makes it easy to set up the complex distributors needed for the supply of the different primary sources of the array.

By contrast, one of the drawbacks of the symmetrical strip line technology lies in the fact that, until now, there has been no primary source with circular polarization directly extending the symmetrical strip supply line.

Indeed, the known primary sources with circular polarization (helical antennas, "candle" type antennas etc.) do not work in the same mode as the symmetrical strip line and therefore necessitate, in addition to the mechanical and electrical interfacing of the source with the symmetrical strip line, a change in excitation mode that is detrimental to optimal functioning of the source.

Besides, the radiating elements made up until now in symmetrical strip line technology do not provide any circular polarization and, therefore, in order to obtain a polarization mode such as this, it is necessary to add on polarizers to them, such as polarizers with dielectric strips, screws, wires, etc. with all the correlative matching losses and manufacturing difficulties.

SUMMARY OF THE INVENTION

It is a first object of the invention is to propose a new form of primary source with circular polarization which can directly extend the symmetrical strip supply line, generally formed by one of the branches of an antenna array distributor.

With a source such as this, in order to produce the radiation, it is possible to use the TM mode or quasi-TM mode, characteristic of the symmetrical strip lines, which gives an excellent bandwidth.

It will be seen, furthermore, that the very simple structure of the source according to the invention leads to low-cost factory production, which is especially advantageous for making arrays that include a large number of primary sources.

Essentially, the invention comprises extending the supply line by two orthogonal symmetrical strip line dipoles supplied by a phase-shifter, the output branches of which are directly extended so as to form the two dipoles, in order to constitute a single-block primary source radiating a circularly-polarized wave (it is known, indeed, that to produce a circularly-polarized wave, two neighboring orthogonal dipoles must be excited by signals that have the same amplitude but are in quadrature).

It is a second object of the invention to propose an antenna structure which, with the same wideband characteristics, compactness and simplicity of construction, permits, in addition to the (right-hand or left-hand) circular polarization, a linear (rectilinear) polarization added on to the circular polarization, this linear polarization being typically a vertical and/or horizontal rectilinear polarization.

As shall be seen, the antenna of the present invention makes it possible, notably, by using a single radiating element and by simple selective switching-over of the input channels of the signal, to obtain the following as desired:

a right-hand circular polarization,
a left-hand circular polarization,
a horizontal rectilinear polarization and/or
a vertical rectilinear polarization.

This characteristic of an antenna with multiple polarizations is especially valuable for antennas that simultaneously fulfill two functions, for example, the conventional function of surveillance (obtained by a circular polarization) and an IFF (Identification Friend or Foe) function obtained by a rectilinear polarization.

To this effect, the antenna according to the invention, which is excited by a symmetrical strip supply line, including two peripheral conductors positioned respectively above and below a central conductor, comprises:

symmetrical strip line excitation means including a symmetrical and wideband 90° hybrid coupler, with a first output branch and second output branch and at least one input branch receiving a signal to be radiated, from the symmetrical strip line;

a first dipolar radiating element, including two quarter wave branches formed by extending each of the peripheral conductors of the symmetrical strip line in their plane, transversely and in a same direction, and one quarter wave branch formed by extending the first output branch of the 90° hybrid coupler in its plane, parallel to the above-mentioned two branches but in an opposite direction;

a second dipolar radiating element, orthogonal to the first one, including two quarter wave branches formed by the folding, in opposite directions, respectively of the second output branch of the 90° hybrid coupler and of one of the peripheral conductors, these two quarter wave branches being coplanar and coaxial and extending perpendicularly to the planes of the conductors.

In this way, the dipolar radiating elements are excited by respective similar signals that have the same amplitude but are phase-shifted by 90°, and the signal to be radiated is thus circularly polarized.

It is notably possible to apply the signal to be radiated, selectively, to either of the input branches of the 90° hybrid coupler depending on the direction, whether left-hand or right-hand, chosen for the circular polarization.

Advantageously, to make it possible, as indicated above, to combine a rectilinear polarization with the circular polarization, the symmetrical strip line excitation means include a second 90° hybrid coupler, cascade-mounted with the first one. A first output branch and a second output branch are connected to the first input branch and second input branch of the first coupler. At least one input branch receives a signal to be radiated, from the symmetrical strip line, so as to excite the dipolar radiating elements by respective similar signals, having the same amplitude and phase, and thus linearly polarizing the signal to be radiated.

It is notably possible to apply the signal selectively to either of the input branches of the second 90° hybrid coupler as a function of the direction, whether vertical and/or horizontal, chosen for the rectilinear polarization.

BRIEF DESCRIPTION OF THE DRAWING

We shall now describe an exemplary embodiment of the invention, with reference to the appended figures.

DESCRIPTION OF THE PREFERRED EMBODIMENTS

Figure 1:
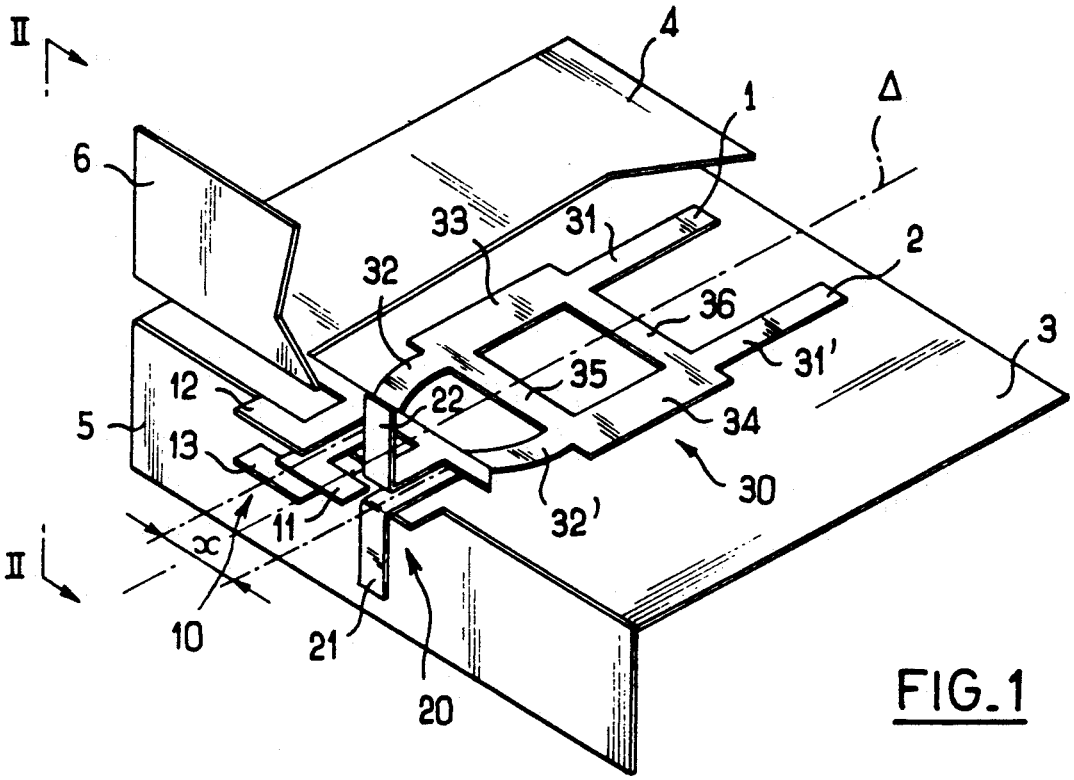
FIG. 1 shows a view in perspective of the antenna according to the invention, one of the ground planes of the symmetrical strip line being shown in a partially cut-away view.
Figure 2:
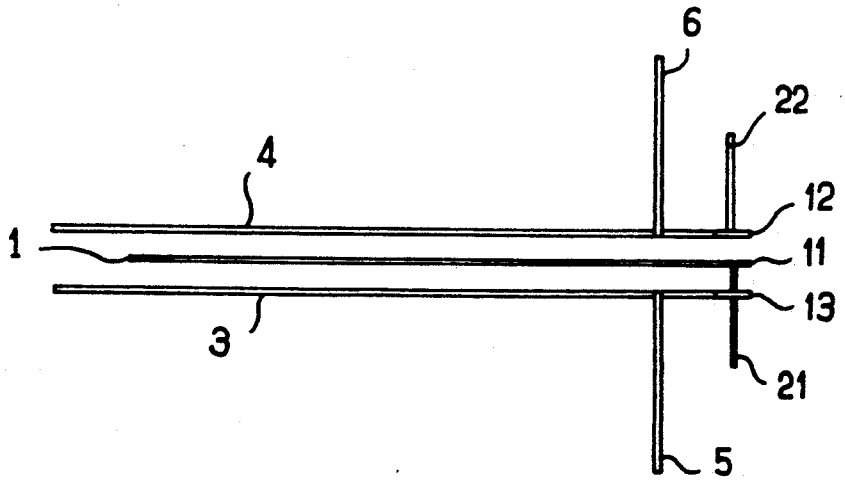
FIG. 2 shows a view in elevation, along II—II of FIG. 1 of this same antenna.

In FIG. 1, the symmetrical strip supply line is formed by central conductors such as 1 or 2 sandwiched between two peripheral conductors 3 and 4 forming ground half-planes. These various conductors are made in the form of plates or rigid strips positioned in parallel to one another and separated by an appropriate dielectric which may be air and, in this case, spacers are simply provided to hold the different elements of the line precisely in their place.

The symmetrical strip line may notably constitute the end of one of the branches of an array antenna distributor (not shown).

As shall be described further below, this supply line excites, first of all, a horizontal dipole 10 designed to produce the horizontal component of the circular polarization of the wave and, secondly, a vertical dipole 20 designed to produce the vertical component of this very same circular polarization.

It will be noted incidently that the terms such as "horizontal" or "vertical" are clearly not restrictive and refer solely to the illustrated embodiment which corresponds to the most common configuration in array antennas, where the symmetrical strip line distributors are generally horizontal. However, this orientation is in no way restrictive and any other absolute orientation in space could be opted for, provided that the condition, cited further below, of orthogonality between the two dipoles is met.

Following the same line of thought, although the invention has been described herein essentially in the form of a source emitting a circularly-polarized wave, this very same antenna can also be used, by virtue of the principle of reciprocity, as a reception antenna without any modification.

The horizontal dipole 10 is made by the extension, transversely (i.e. perpendicularly to the axial direction of the antenna represented by the axis Δ), of the central conductors of the supply line by a branch 11 forming one of the halves of a dipole. The other half of the dipole is formed by branches 12, 13 formed by the extension, transversely on the other side of the axis Δ (but on the same side for the two branches 12 and 13), of the peripheral conductors 3 and 4 of the supply line.

The branches 11, 12 and 13 have the same length, equal to about a quarter wave.

The dipole 20 is formed by a downward folding of another central conductor, which gives the branch 21, and an upward folding of one of the peripheral conductors (herein, the upper conductor 4), which gives the second branch 22 of the dipole 20. These two branches 21 and 22 also have a length of about one quarter wave.

The peripheral conductors 3 and 4 are folded at 5 and 6 so as to form a ground plane constituting the short-circuit plane of the dipoles 10 and 20.

The dipoles 10 and 20 are supplied jointly by means of a coupler 30 interposed between the central conductors 1 and 2 and the dipoles 10 and 20.

This coupler makes it possible, in a manner known per se to excite the two dipoles of the antenna with a relative phase shift of 90° (quadrature).

Herein, the coupler 30 is a coupler of the "90° hybrid coupler" type, also called a "3 dB coupler", a "3 dB hybrid ring" or a "3 dB ladder".

This 90° hybrid coupler, which is known per se, essentially has two input branches 31 and 31' which are symmetrical (from the radio-electrical point of view) and two output branches 32 and 32' which are also symmetrical. These four branches end in four segments 33, 34, 35 and 36 each of which has a length of about one quarter wave. These segments 33 to 36 may be rectilinear, as illustrated in the figure (and the term generally used in this case is "ladder coupler") or curvilinear (and the term generally used then is "hybrid ring"), or they may even assume more complex shapes, the important parameters being the length and the width of the transmission lines formed by these segments.

The dimensions of the input branches 31 and 31', the output branches 32 and 32' and the lines 35 and 36 are such that these elements are all matched with the characteristic impedance of the antenna and of its associated circuits, which is typically 50 ohms. By contrast, the lines 33 and 34 are given a greater width, so as to create an impedance mismatching. This mismatching is such that the signals applied to either input branch 31 or 31' will get divided and, owing to the delays introduced by the quarter wave lines 33 to 36, will give each of the output branches 32 and 32' similar signals, of the same amplitude but phase-shifted by 90°.

A 90° hybrid coupler has a certain number of advantages, notably the fact that it enables an almost constant phase shift of 90° to be maintained on a very wide frequency band, typically on a bandwidth of 20%, with an SWR that is little affected by the frequency variations in this band. In other words, this hybrid coupler remains perfectly matched, even if the frequency varies around the central frequency for which it has been computed.

Thus, if a signal is applied to the input branch 31 of the hybrid coupler 30, there will be achieved, owing to the symmetrical supply which is equal in amplitude but is in quadrature, a right-hand circular polarization while, if the signal is applied to the input branch 31' of the hybrid coupler 30, a reverse circular polarization will be obtained, i.e. a left-hand circular polarization.

Advantageously, the supply system of the antenna can be configured so as to radiate not only the circular polarization (right-hand or left-hand) but also a rectilinear (vertical and/or horizontal) polarization (it may be particularly useful, in certain applications, to make simultaneous use of both rectilinear polarizations crossed).

To this effect, it is possible to short-circuit certain parts of the coupler selectively, for example by means of PIN diodes, so as to excite only one of the two dipoles.

Figure 3:
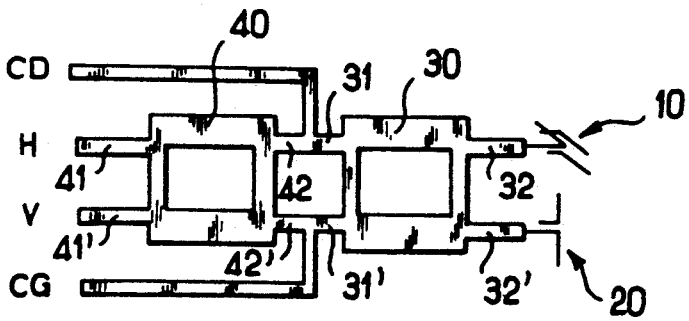
FIG. 3 illustrates an alternative embodiment, in which two cascade-mounted couplers can be used to obtain, in addition to circular polarizations, rectilinear polarizations.

It is preferred, however, to use the approach illustrated schematically in FIG. 3, wherein there is provided a second 90° hybrid coupler, referenced 40, mounted upline of the first one. The two couplers 30 and 40 are cascade-mounted, i.e., the two output branches 42, 42' of the upline coupler 40 are directly connected to the input branches 31, 31' of the downline coupler 30.

By selective switching over, the signal to be radiated is applied to either of the two input branches 41, 41' of the upline coupler 40 and/or to either of the input branches 31, 31' of the downline coupler 30.

It is thus possible to obtain, simultaneously or successively, with one and the same radiating assembly (i.e. with one and the same pair of dipoles 10, 20):

a right-hand circular polarization, if the signal is applied by the input branch 31 of the downline coupler 30, a left-hand circular polarization, if the signal is applied by the input branch 31' of the downline coupler 30, a horizontal rectilinear polarization, if the signal is applied by the input branch 41 of the upline coupler 40, and a vertical rectilinear polarization, if the signal is applied by the input channel 41' of the upline coupler 40.

The selection of the desired polarization could be obtained easily in a manner known per se by the switching over of the different channels, for example by means of PIN diodes.

An elementary antenna of such a type is particularly well suited to the setting up of a plane array which may include several tens or several hundreds of radiating elements.

Each radiating element will then be associated with a hybrid coupler which is proper to it, the different couplers being supplied appropriately, in a manner also known per se, by appropriate distributor circuits.

The configuration of the radiating element/hybrid coupler assembly of the present invention makes it possible to have a very compact arrangement. This will enable the various radiating elements to be brought close to one another to the maximum extent. Now, it is known that, in an array antenna, if it is desired to prevent the appearance of array lobes which are detrimental to a wide angular coverage, the various radiating elements should be made to approach each other as far as possible, ideally with a spacing of not more than half a wavelength.

It will be noted that, in the antenna of the invention, the respective phase centers of the two dipoles will be slightly offset owing to their respective positions (distance between centers x). Of course, this offset induces a slight dissymmetry and, therefore, a slight defect of circularity of the polarization for the radiating element, but this defect can be easily compensated for by alternating the positioning of the dipoles from one radiating element to the next one in the array.

It is thus observed that a distance between centers x of the order of 0.25 λ gives satisfactory operation, provided that the circularity defect is compensated for by alternating the positioning of the dipoles in the array, as we have just indicated. By positioning the vertical dipole 20 in a slightly withdrawn position with respect to the horizontal dipole 10, it is possible to further reduce this distance between centers, for example up to a value of the order of 0.15 λ.

An antenna such as this can be made for all the frequency bands in which the symmetrical strip line technology can be implemented, typically the L, S and C bands.

What is claimed is;

1. An antenna with circular polarization excited by a symmetrical strip line feed line having two peripheral conductors positioned respectively above and below a central conductor, comprising:

symmetrical strip line excitation means including a symmetrical and wideband 90° hybrid coupler, with a first output branch and second output branch and at least one input branch receiving a signal to be radiated, from the feed line;

a first dipolar radiating element, including a first pair of quarter wave branches, formed by extending each of the peripheral conductors of the symmetrical strip line feed line in the same direction transverse to an axis of the symmetrical strip line feed line, and another quarter wave branch formed by extending the first output branch of the 90° hybrid coupler, parallel to the pair of quarter wave branches but in an opposite direction;

a second dipolar radiating element, orthogonal to the first one, including two quarter wave branches formed folding, in opposite directions, transverse to said first dipolar radiating element and said axis, respectively the second output branch of the 90° hybrid coupler, and one of the peripheral conductors, the two quarter wave branches of the second dipolar radiating element being coplanar and extending along a common axis perpendicularly to the planes of the axis of the symmetrical strip line feed line; and, the dipolar radiating elements being excited by signals from said coupler that have the same amplitude but are phase-shifted by 90°, and thus circularly polarize signal to be radiated.

2. The antenna of claim 1, wherein the signal to be radiated is applied, selectively, to either of first and second input branches of the 90° hybrid coupler to select either left-hand or right-hand circular polarization.

3. The antenna of claim 1, wherein the symmetrical strip line excitation means includes a second 90° hybrid coupler having at least one input branch, and having a first output branch and a second output branch connected, respectively, to a first input branch and to a second input branch of the first coupler, and at least one of said input branches receiving a signal to be radiated;

whereby the dipolar radiating elements are excited by signals having the same amplitude and phase linearly polarizing the signal being radiated.

4. The antenna of claim 3, wherein the signal to be radiated is applied selectively to either of first and second input branches of the second 90° hybrid coupler to obtain either vertical and/or horizontal rectilinear polarization.

5. The antenna of claim 1 further comprising a common ground plane for said first and second dipolar radiating elements.

* * * * *